United States Patent [19]

Eigenbrode et al.

[11] 4,252,397

[45] Feb. 24, 1981

[54] INSULATION PIERCING ELECTRIC CONNECTOR BONDED TO ELECTRIC CONDUCTOR

[75] Inventors: George T. Eigenbrode, Wilmington; William C. Hoffman, Jr., Newark, both of Del.

[73] Assignee: E. I. Du Pont de Nemours and Company, Wilmington, Del.

[21] Appl. No.: 57,112

[22] Filed: Jul. 12, 1979

Related U.S. Application Data

[63] Continuation-in-part of Ser. No. 935,388, Aug. 21, 1978, abandoned.

[51] Int. Cl.[3] ..... H01R 4/02

[52] U.S. Cl. ..... 339/99 R; 339/275 R; 339/275 T; 29/860

[58] Field of Search ..... 339/97 R, 97 C, 97 P, 339/98, 99 R, 275 R, 275 T

[56] References Cited

U.S. PATENT DOCUMENTS

| | | | |
|---|---|---|---|
| 2,759,161 | 8/1956 | Berg | 339/97 C |
| 3,320,354 | 5/1967 | Marley et al. | 339/97 C |
| 4,066,316 | 1/1978 | Rollings | 339/97 R |
| 4,082,402 | 4/1978 | Kinkaid et al. | 339/97 C |

*Primary Examiner*—John McQuade

[57] ABSTRACT

An electrical wiring device comprising an insulated flat cable having a plurality of parallel electrical conductors disposed in a plane and encased in a flexible insulation with at least one connector assembly permanently attached for plug-in service is provided. Also provided is a method of making the device in which insulation-piercing interconnecting elements are passed through the insulation, have a tight bight of conductor formed outside the insulation and are permanently bonded to tines in each interconnecting element, and the associated parts are enclosed in a dielectric housing.

18 Claims, 20 Drawing Figures

INSULATION PIERCING ELECTRIC CONNECTOR BONDED TO ELECTRIC CONDUCTOR

PRIOR APPLICATIONS

This application is a continuation-in-part of our copending application Ser. No. 935,388 filed Aug. 21, 1978, now abandoned.

DESCRIPTION

1. Technical Field

This invention relates to an electrical wiring device and more specifically to a wiring device having insulation-piercing interconnecting element bonded to conductor.

2. Background

There is a need in the industry for connector assemblies to maintain electrical continuity under extreme service conditions of vibration and atmospheric influences such as corrosion without loss of integrity. This requirement, of course, is in addition to other requirements such as ease of fabrication, convenient termination, and adaptability to a variety of termination mechanisms.

Insulation piercing termination is well known in the prior art.

U.S. Pat. No. 3,820,058, issued June 25, 1974 to L. C. Friend, discloses a pierce-type connector for a ribbon cable having a body and a pair of contact tines extending from the body. The tines diverge laterally from each other, have insulation pierce tips at their free ends, and include conductor engaging corners diverging outwardly from the body. During termination the corners engage the conductor thereby creating a mechanical contact between connector and conductor. Such an arrangement might, however, be susceptible to increasing contact resistance during extreme service conditions.

U.S. Pat. No. 3,878,603, issued Apr. 22, 1975 to L. A. Jensen, et al. discloses a method for solderless splicing of multi-element cable whereby individual insulated conductors are placed into slots of a cable-retaining member and engaged by forked-legged connectors capable of cutting through the sides of the insulation. This type of connection, however, might also suffer from the disadvantage described above.

Other types of connector to conductor contacts are also known. U.S. Pat. No. 3,615,283, issued Oct. 26, 1971 to D. D. Long, discloses conductors with loose-fitting insulating jacket which are formed into terminal loops through a punching operation. The punching process, performed by a punch and a die, cuts away a portion of the insulation and is followed by the loop formation which involves the pulling of the conductor relative to its own insulation. The resulting bare terminal loops, and the contacts formed with them, however, are subject to the effects of the environment and the disclosed process is limited to individual wires of a cable having loose-fitting insulating jackets. A similar process is disclosed in U.S. Pat. No. 3,636,991, issued Jan. 25, 1972 to A. D. Webster.

U.S. Pat. No. 782,391, issued Feb. 14, 1905, to A. P. Hanson, discloses cable conductors whose insulating layer is perforated or cut away at certain points to permit connection to conductors. The connection is said to be by contact or by means of a drop of solder through the gaps of the insulating layer.

U.S. Pat. No. 3,772,775, issued Nov. 20, 1973 to H. R. Bonnke, et al., discloses a method for connecting terminals on a printed circuit board to a flat cable by abrading a pair of windows in the cable insulation and pressing the board between the windows into a spring clip thereby forcing the exposed conductor in the standing parts of the bight so formed into contact with the terminals of the board. Contacts so formed, however, might become loosened by vibration during use.

Laser beam welding (LBW) has been applied to spot welding very small wires, as described in "Lasers in Metalworking," American Machinist Special Report No. 679, July 1, 1975, and "Welding," American Machinist Special Report No. 698, September, 1977. See also U.S. Pat. No. 3,534,462, issued Oct. 20, 1970 to D. G. Cruickshank, et al., disclosing a method for bonding a plurality of leads to a workpiece utilizing laser beams shaped into a predetermined pattern; U.S. Pat. No. 3,718,968, issued Mar. 6, 1973, to S. D. Sims, et al., disclosing a method for connecting wire to a component including a step of preheating and deforming the wire; and U.S. Pat. No. 3,610,874, issued Oct. 5, 1971, to F. P. Gagliano, disclosing a method of bonding a conductive metal tab to a metal conductor wire through laser beam welding by positioning tab and wire so that the axis of the laser beam, applied vertically downward, forms an angle of between 30° to 50° with respect to the tab surfaces, and is directed at a position on the tab displaced from the conductor.

DISCLOSURE OF THE INVENTION

An electrical connection comprising a terminal having tines on one end and an electrical contact on the other end, said tines defining a slot terminating in a base; an insulated electrical conductor in said slot having a portion bent back on itself forming a bight over the base of said slot such that a loop is formed, said loop being at least one conductor thickness high, said conductor being exposed at the apex of said bight; said one end of said terminal and the exposed apex of said bight being permanently bonded to form an electrical connection; and a dielectric body surrounding said connection, said body having an optional opening leading to said bight and having an opening leading to said electrical contact at the other end of said terminal.

Also, an electrical connector comprising insulated flat cable with a plurality of parallel electrical conductors encased in a uniform tight-fitting insulation; at least one connector assembly in electrical attachment to the cable, the assembly usually including insulating foundation and cover attached to each other and interconnecting elements mounted in said foundation in line array, there being usually one interconnecting element for each conductor in each assembly; each interconnecting element comprising a conductive blade having first and second ends, the first end formed as an insulation piercing forked contact and the second end is formed as an electrical terminal for plug-in service; the forked end or tines disposed in at least one plane normal to the flat cable; and the insulation-piercing end extending through the insulation of the cable such that a conductor is formed into a bight outside its insulation and in electrical contact with said first end, the apex of the bight being disposed between tines of the insulation piercing end and over the base of a slot therebetween.

The method of making the connector involves simultaneously penetrating insulated wire cable with a plurality of insulation-piercing interconnecting elements, simultaneously bottoming the conductors in the slots of the interconnecting elements, displacing the cable relative to the interconnecting elements so that a limited length of each of the bottomed conductors in the cable is outside the insulation causing the displaced conductors to be bent back on themselves such that a loop is formed at least one conductor thickness high and the apex of the loop is a bight over the bottom of the slot in the interconnecting element, permanently bonding the bight to the interconnecting element by a laser beam or other appropriate bonding technique and covering the interconnecting elements with a dielectric housing to form an insulated connector suitable for plug in service.

BRIEF DESCRIPTION OF THE DRAWINGS

FIG. 6 is a perspective view in partial cross-section showing still another alternate connector with a further configuration of the female contacts of the interconnecting elements, shown prior to forming the permanent bond.

FIG. 18 is a perspective view of the foundation portion of the dielectric housing with the tines in place and the conductor bent over the base of the tines. The laser welding step and permanent bond is depicted after crimping of the conductor to the tines.

DESCRIPTION OF THE INVENTION

The electrical connection of this invention is formed between an electrical conductor encapsulated in an insulation and a forked terminal having tines on one (the forked) end and an electrical contact on the other end. The conductor is formed into a bight over the base of a slot defined by the tines. The conductor is exposed at the apex of the bight and there is a permanent bond between the terminal at or near its forked end and the conductor at or near its apex.

The bond is a metallurgical bond such as a weld made by laser welding. Mechanical crimping of the tines prior to welding is preferred.

Figure 1:
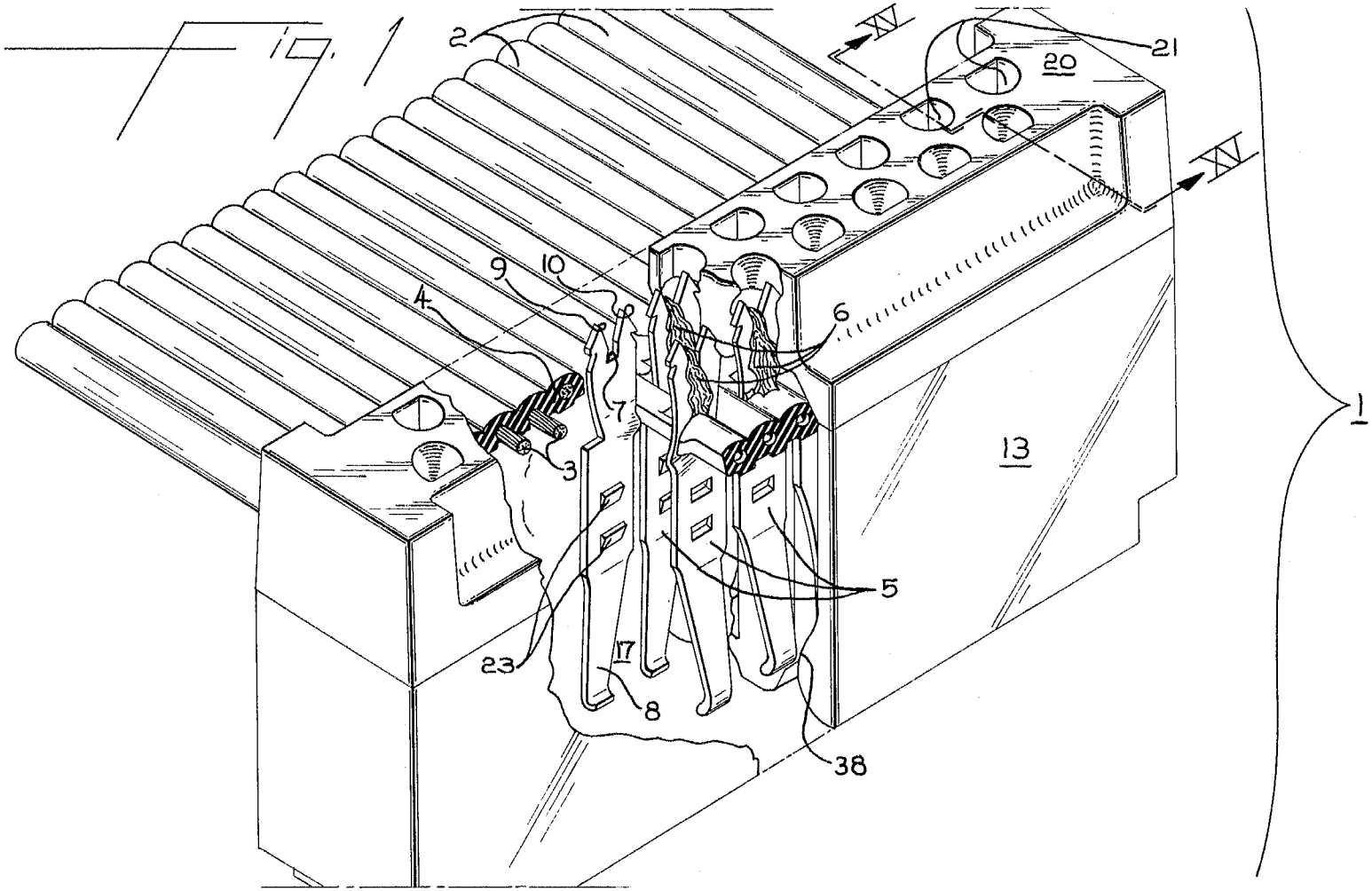
FIG. 1 is a perspective view in partial cross-section of a connector according to this invention shown prior to forming the permanent bond.

Connector 1 of this invention is shown in FIG. 1 in assembled form terminating flat cable 2 which is comprised of a plurality of conductors 3. These are encapsulated in insulation 4 which ordinarily has the ridge and furrow external configuration shown and can be extruded or laminated into a unitary structure with the insulation 4 bonded to or in tight relationship with conductors 3.

The insulation 4 can be made from any of a variety of elastomeric or polymeric materials. For most electronic service such as wiring assemblies for computers polyvinyl chloride is preferred but "Teflon" fluorocarbon resin (registered trademark of E. I. du Pont de Nemours and Company) can also be utilized.

Preferred conductors 3 are standard and tinned, commercially-pure copper wire, approximately 26–32 gage (A.W.G). However, any conductive material of any desired and functional gage can be used and the article of manufacture of the invention is adaptable to solid conductors as well.

A most preferred conductor is 28 A.W.G. (7 strands A.W.G. 36) manufactured by Ernst U. Engbring & Co., style No. 2651, FR1, 105° C. having a conductor spacing on 0.050 centers.

Each conductor 3 is in electrical contact with an insulation-piercing interconnecting element 5 which is an elongated blade-like metal member and which transfixes insulation 4 on either side of a conductor 3. The width of the blade in the plane of flat cable 2 is approximately the same as or slightly larger than the spacing between conductors 3. See FIG. 18.

Figure 2:
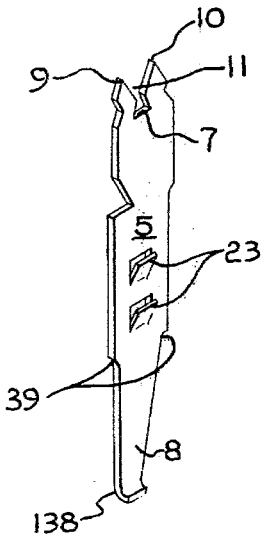
FIG. 2 is a perspective view of a single beam insulation-piercing interconnecting element used in the connector of FIG. 1.

A single such element, known as the "single beam" type, is shown in FIG. 2. It has one leg 8 available for contact with a plug-in male unit (not shown). The blade-like shape has shoulders 39 which seat in the bottom of T-slots, not shown, in foundation 13 of connector 1. To provide an interconnecting element 5 for each conductor 3, the elements 5 are in staggered line array, thus accommodating the width of element 5 as can be seen in FIG. 1. Elements 5 are preferably fabricated from cupro-nickel, a copper/nickel/tin alloy (such as 89/9/2, by weight) with, typically, 30 micro inch (0.75 micrometer) gold in contact area 138. Any other common connector material or plating can be employed.

Figure 3:
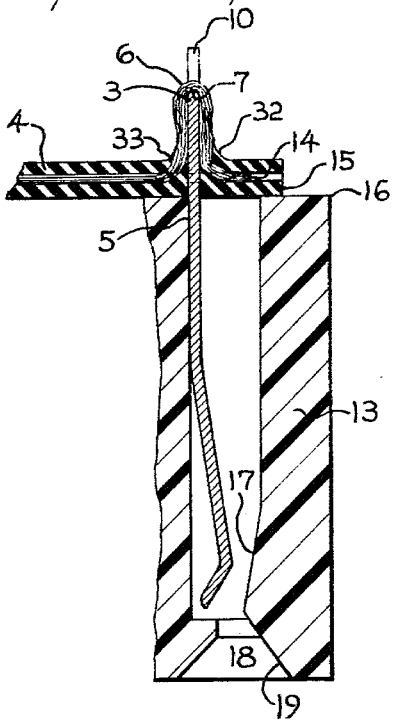
FIG. 3 is an enlarged cross-sectional view showing a junction of conductor and interconnecting element within the connector of FIG. 1.

Referring to FIG. 3, each conductor 3 passes out of insulation 4 in close proximity to the side of element 5 and forms a tight bight 6 passing through and bottomed in slot 7 in element 5 and is external to the insulation (except that a small piece of insulation may be present under the bight. If present it will cushion the conductor 4 against the base of slot 7). The conductor 3 then returns in close proximity to the other side of element 5 into insulation 4.

Although electrical contact is formed between interconnecting element 5 and conductor 3 in the above configuration (see also FIG. 4), for the purpose of insuring good and continued electrical contact during extended service with superior resistance to vibration and corrosion, each bight 6 is permanently bonded to its associated interconnecting element 5. Bonding techniques include crimping, soldering, induction or resistance welding, thermocompression bonding, ultrasonic welding, electron beam and laser welding. Preferably, laser welding, preceded by squeezing of the tines as will be discussed in greater detail below, is the bonding method utilized. It should be noted that the configuration of bights 6 and elements 5, extending normal to and external of the plane of flat cable 2, is particularly amenable to a variety of bonding techniques because the junction is accessible during the manufacturing process from both sides as well as from above.

Element 5 is further characterized by being forked, having two insulation-piercing tines or tips 9 and 10 disposed on either side of slot 7. The preferred tips are arrowhead-like in form with the inner surfaces of the arrowheads forming a throat 11 which is proportioned to be slightly smaller than the original diameter of a conductor 3 and smaller than the greatest extent of the base of slot 7.

In the regions where elements 5 transfix insulation 4, the insulation is somewhat bunched or compressed as suggested at 32 and 33. Indeed this compression is such that if the termination is carried out in close proximity to an end of flat cable 2, the grip between insulation 4 and conductors 3 is broken and insulation 4 is thereby displaced relative to conductors 3 such that conductor ends 14 are retracted from the end of insulation 15. Ends of conductors 14 do not extend outside the end of insulation 15 protecting the conductors 3 from unwanted electrical contacts. However, if termination is done at a distance from the ends of flat cable 2, often called "daisy chaining" substantially no such end displacement occurs (see FIG. 11), relative motion between conductor and insulation occuring only in the vicinity of the bight formation.

Insulation-piercing interconnecting elements 5 are mounted in foundation 13 of connector 1 (see FIG. 1). A preferred mode of accomplishing this is by mechanical insertion. Tabs 23 help lock elements 5 in place against the wall. Ultrasonic insertion and insert molding are alternative but less-preferred assembly modes.

Elements 5 are disposed within foundation 13 so that tips 9 and 10 extend above upper surface 16 of foundation 13 and legs 8 extend into cavities 17. As shown by FIG. 3, cavities 17 are open to the outside through apertures 18, a series of suitably aligned holes with external inward-directing tapered surfaces 19, to facilitate plugging in male connecting devices (not shown). Thus, each leg 8 functions as a female contact. Where used with a single beam leg 8, cavity 17 is preferably provided with a wall 38 shaped to support the male pin to be inserted. Foundation 13 can be molded from any suitable reinforced plastics such as glass-filled polyester or polycarbonate.

Referring again to FIG. 1, the connector 1 has a cover or cap 20 which is attached by suitable means to foundation 13. Cap 20, molded from any suitable plastic, has a series of holes 21 each aligned to receive the ends of an interconnecting element 5 in an interference fit with the breadth of the element. Preferably, the insertion of the insulation-piercing ends of elements 5, carrying the tight bights of conductors 3, into holes 21 of cap 20 is carried out ultrasonically as will be discussed further below. This technique bonds cap 20 both to elements 5 encased in foundation 13 and to foundation 13 on the ends.

Figure 5:
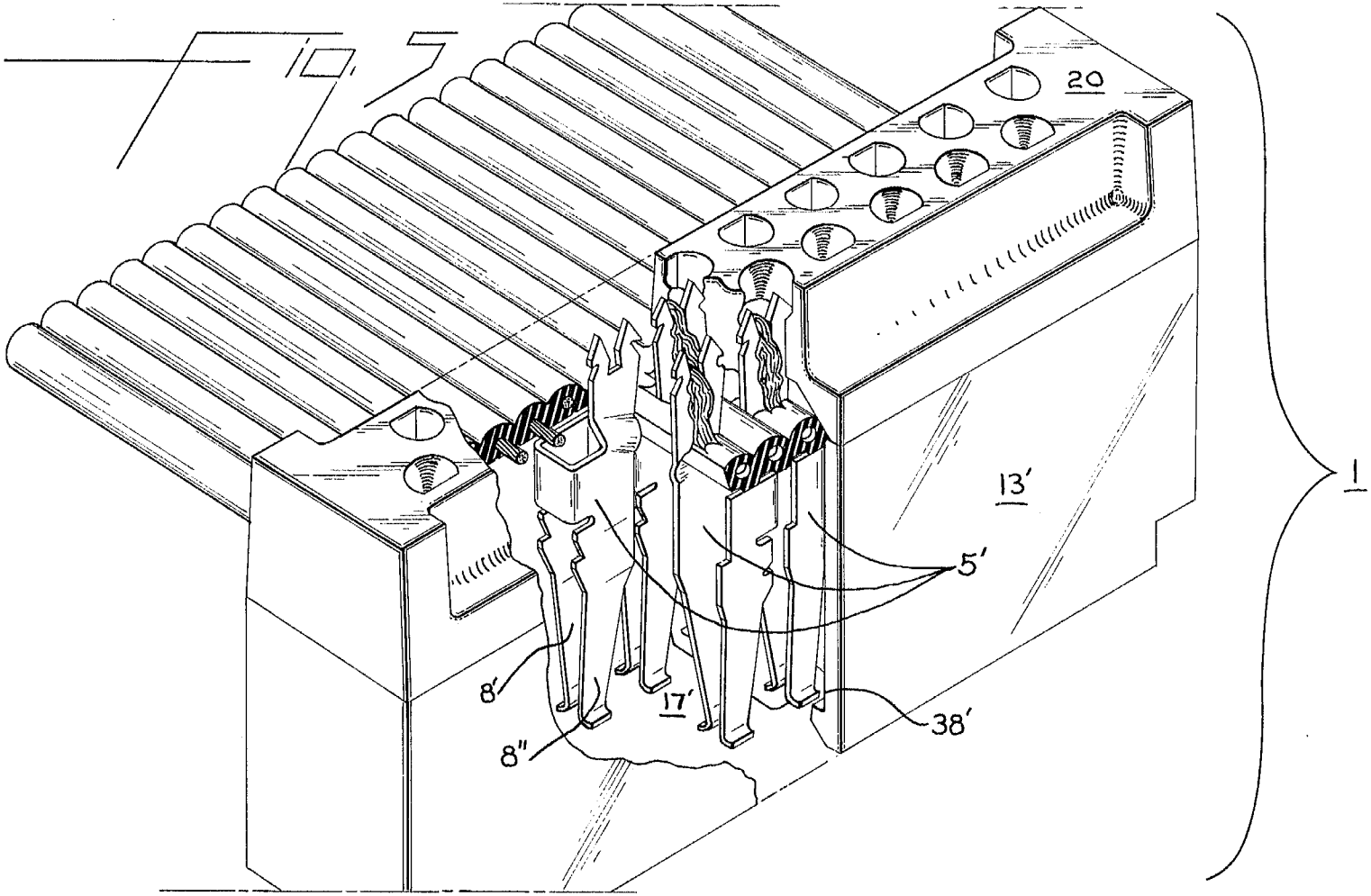
FIG. 5 is a perspective view in partial cross-section of an alternate connector according to this invention showing a different configuration of the female contacts than that a FIG. 1, shown prior to forming the permanent bond.
Figure 15:
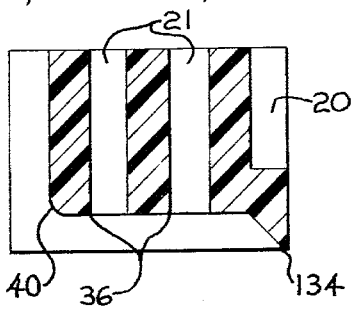
FIG. 15 is a cross-sectional view of the cap or cover of the connector taken on line XV—XV of FIG. 1 and shows a knife-edge structure useful for connectors located at an end of the flat cable.

FIG. 15 shows cap 20 in the form used for termination near the end of flat cable 2, having internal edges 36 and external rounded edge 40. Cap 20 can also function to cut and detach the ends of insulation 4 with knife edge 134 when the insulation extends beyond the ends of conductors 3 and beyond the outside edge of foundation 13. Cap 20 and knife edge 134 electrically insulate the cut wire ends from inadvertent contact with external metallic parts during service. The connectors shown in FIGS. 1, 5 and 6 are shown with cap 20.

Figure 16:
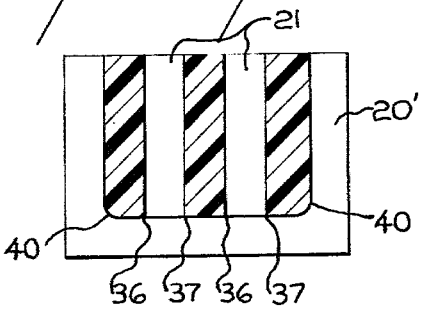
FIG. 16 is a cross-sectional view of an alternate form of the cap of FIG. 15 useful for connectors installed at a distance from the ends of a flat cable.

FIG. 16 shows cap 20′ in the form used for daisy chaining, i.e., where cable 2 continues beyond cap 20′ in both directions. Cap 20′ has internal edges 36 and 37. It may also be used for end termination.

This wiring device is a structure in which each element 5 and its contacting bight 6, preferably bonded to each other, is permanently assembled and is substantially encapsulated within cap 20. Furthermore, strain relief of the bonded junctions is achieved. Thus, when a strain is placed upon cable 2 and transmitted to connector 1 at its end, the strain is relieved where conductors 3 are bent over internal edges 36. For a daisy chain termination, strain in both directions is accommodated by edges 36 and 37 (see FIG. 16).

Figure 17:
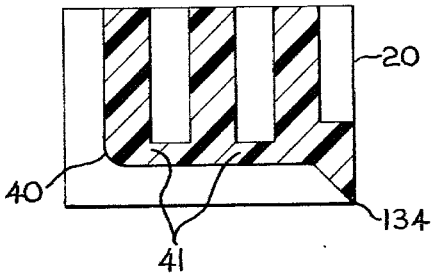
FIG. 17 is a cross-sectional view of an alternate cap to the caps shown in FIGS. 15 and 16.
Figure 10:
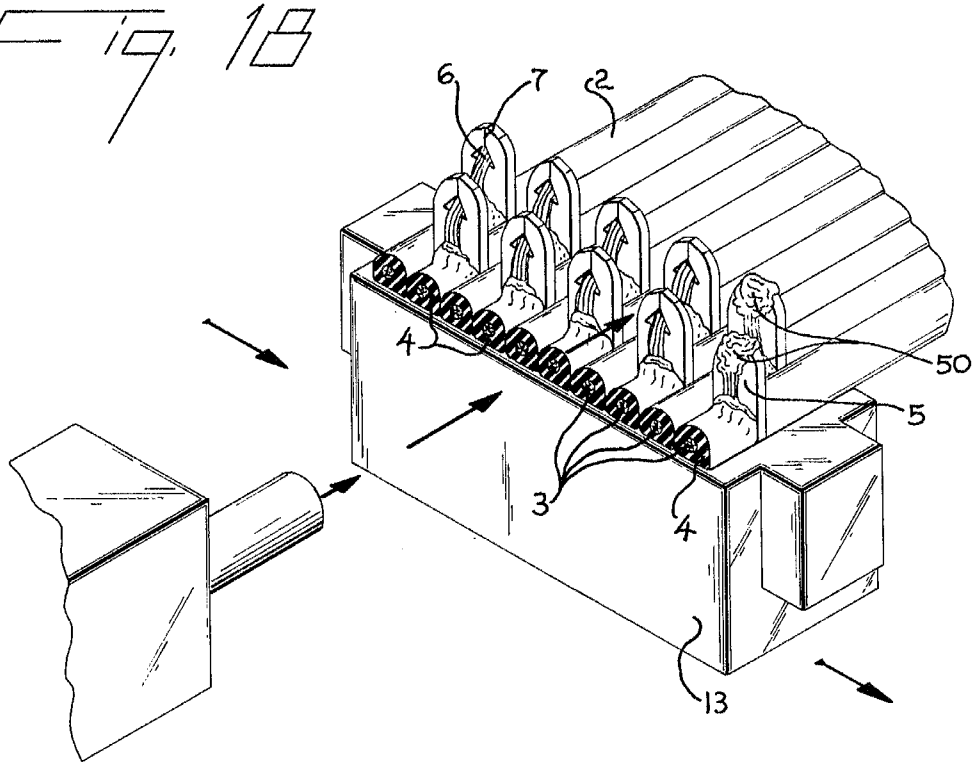

It is preferred to utilize tip-receiving holes 21 in cap 20 which are open ended, as shown in FIGS. 15 and 16. This type of construction permits insertion of test probes to check electrical continuity during the service life of the electrical wiring device. However, internal holes or internal cavities closed to the outside can also be employed as shown in FIG. 17 where web 41 is molded into the structure.

The single beam construction of elements 5 in FIGS. 1 through 3 is a standard configuration. The interconnecting element of this invention, however, can be used with any type of male or female interconnections as has been stated above. FIG. 5 depicts interconnecting elements 5′ formed with two legs 8′ and 8″; a construction known in the art as a "dual beam." Elements 5′ are similar to elements 5 of FIG. 1 except in the formation of the female contact by legs 8′ and 8″. Similarly, foundation 13′ is similar to foundation 13 except in the shape of cavity 17′ which does not require the same shaped wall 38 of cavity 17. Cavity 17′ has relieved shaped wall 38′.

FIG. 6 similarly shows insulation-piercing interconnecting elements 5″, similar to elements 5 of FIG. 1 and 5′ of FIG. 5 except in regard to the configuration forming the female contacts. Here contact receptacles 22 are shown. These are of the type known as MINI-PV dual-metal receptacles (a trademark of E. I. du Pont de Nemours and Company). Wall 38″ is modified to form a cavity 17″ suitable for the enlarged contact. The dual-metal receptacle is a disconnect contact for 0.025 inch square or round pins on minimum 0.100 inch centers and often provides higher reliability than the single or dual beam designs.

Figure 19:
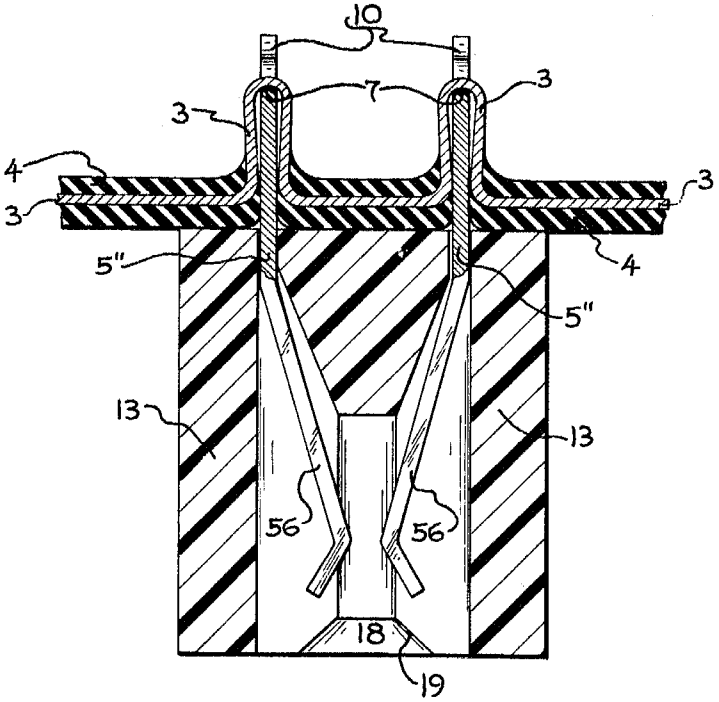
FIG. 19 is a cross-section of an edgecard receptacle contact at one end of a pair of interconnective elements and a pair of tines on the other end of each element engaging an exposed conductor.

A receptacle for an edgecard is shown in FIG. 19. The beams 56 grip the edge of the edgecard and contact strips on the surface of the edgecard. The beams 56 are shown so that they will connect opposite sides of a printed circuit board to the same connector 3. However, the beams 56 may be staggered and each connect a different circuit on opposite sides of a printed circuit board. Of course the number of such beams 56 is a matter of choice.

Figure 20:
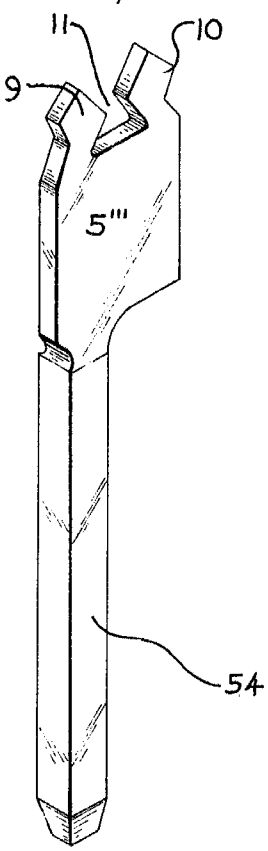
FIG. 20 is a perspective of an alternative interconnective element having at one end a male pin.

An insulation-piercing interconnecting element 5''' in FIG. 20 depicts a male pin 54 at one end for engagement with a suitable female receptacle an another electrical device.

The sequence of terminating cable according to this invention is shown for the configuration of FIG. 5 which features the dual beam type female contact interconnecting element. Time-lapse FIGS. 7–12 show this terminating sequence. (FIG. 3 shows terminated cable with a single beam interconnecting element.)

Figure 7:
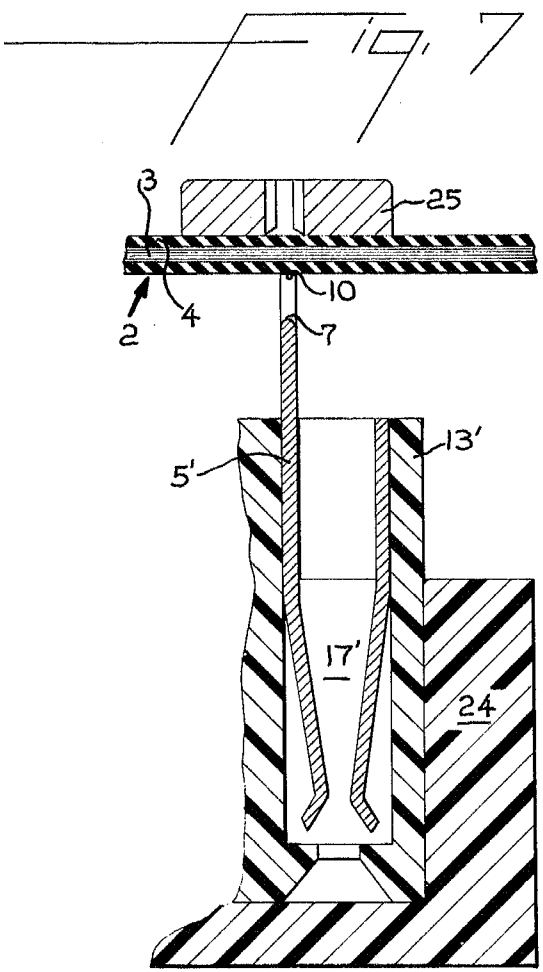
Figure 10:
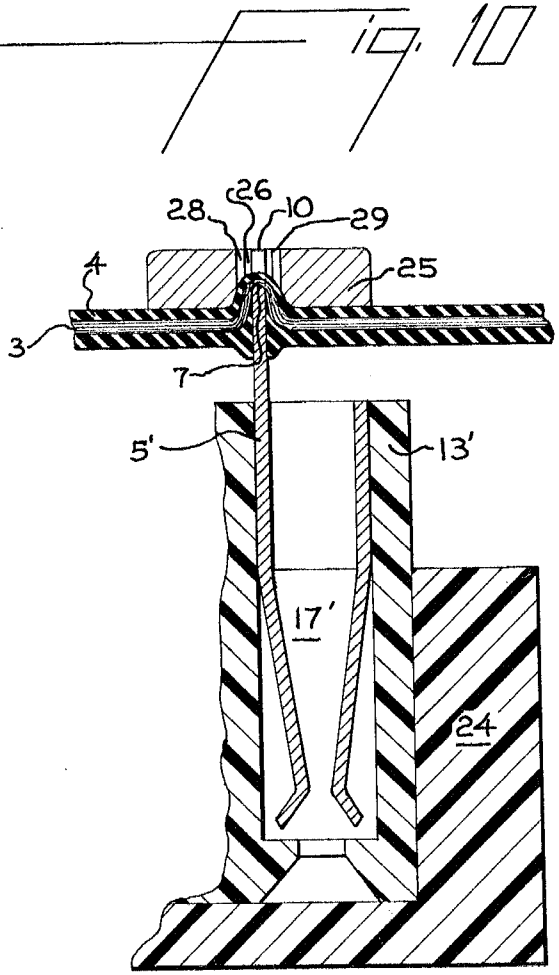
Figure 9:
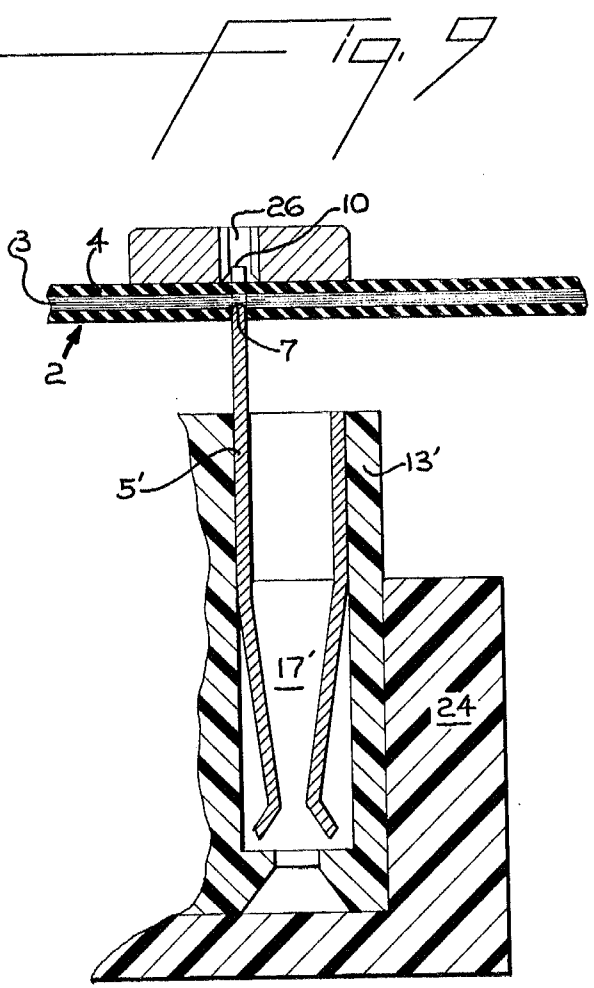

An insulation-piercing interconnecting element 5' mounted in terminal base 13' is shown in cross-section in FIG. 7. Foundation 13' is held in a suitably shaped base tool 24. Flat cable 2 is disposed such that the array of elements 5', a staggered line described above but not shown in FIG. 7 for reasons of clarity, is normal to the plane of cable 2. Insertion tool 25, in association with guiding means (not shown) holds cable 2 in this normal relationship and aligned so that each conductor 3 is approximately positioned above an associated slot 7 of an element 5'.

Figure 4:
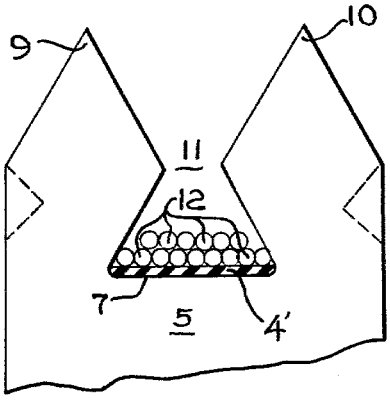
FIG. 4 is an enlarged partial elevational view of the insulation-piercing tip of the element of FIG. 2 showing a stranded conductor in association therewith.
Figure 8:
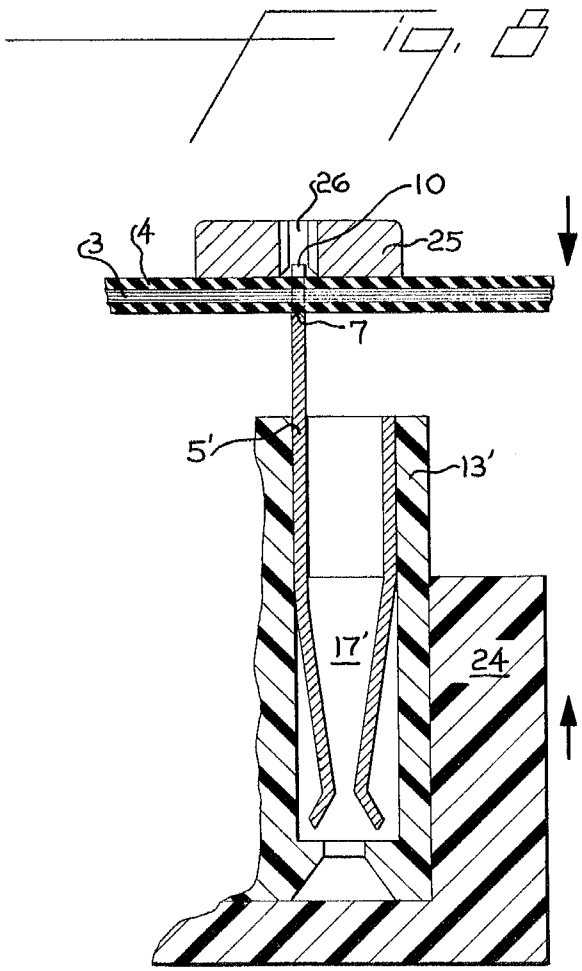

FIG. 8 depicts the beginning of relative motion between base tool 24 and insertion tool 25 in the direction of the arrows causes tips 9 and 10 of elements 5' to penetrate insulation 4 on either side of conductors 3, the tips 9 and 10 passing completely through insulation 4 and entering slot 26 of tool 25 as conductor 3 is funneled into throat 11 (best seen in FIG. 4). Continued motion seats conductor 3 in the base of slot 7 (see FIG. 9). A portion of insulation 4 (shown as 4' in FIGS. 4 and 14) may be caught between slot 7 and conductors 3 and acts as a stress distributing member during further forming.

Figure 11:
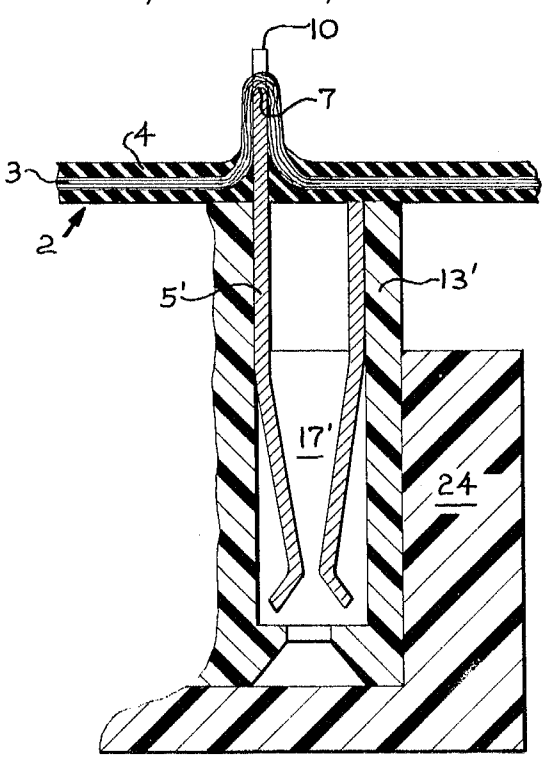
Figure 13:
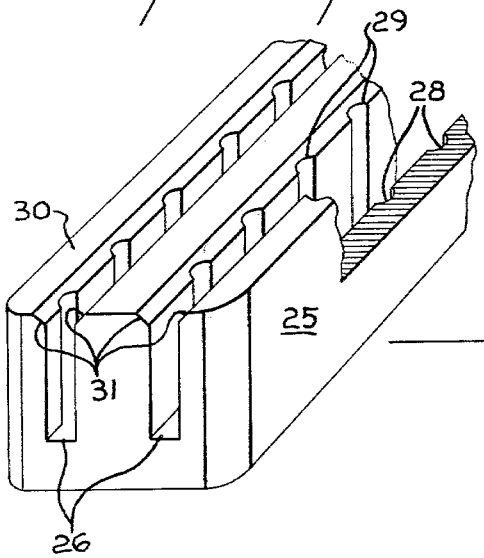
FIG. 13 is a perspective view in partial cross-section of an insertion tool useful in making the connector.

Insertion tool 25, shown in FIG. 13, has one slot 26 for each of the staggered rows of elements 5' and, aligned with the throats 11 of elements 5' which are centered between tips 9 and 10, there are semicylindrical slots 28 and 29 sized to accommodate conductors 3. It is preferred that face 30 of tool 25 be connected with slots 26 by double chamfers 31. These facilitate entry of conductor 3 into slots 28 and 29 and also provide for the necessary stressing of insulation 4 which, referring now to FIG. 11, is deformed to its extreme and breaks moving over the conductors 3 to a rest position. Tools of this type are employed in a variety of presses, details of press operation and the means by which the tools are attached or guided are well known.

Figure 10:
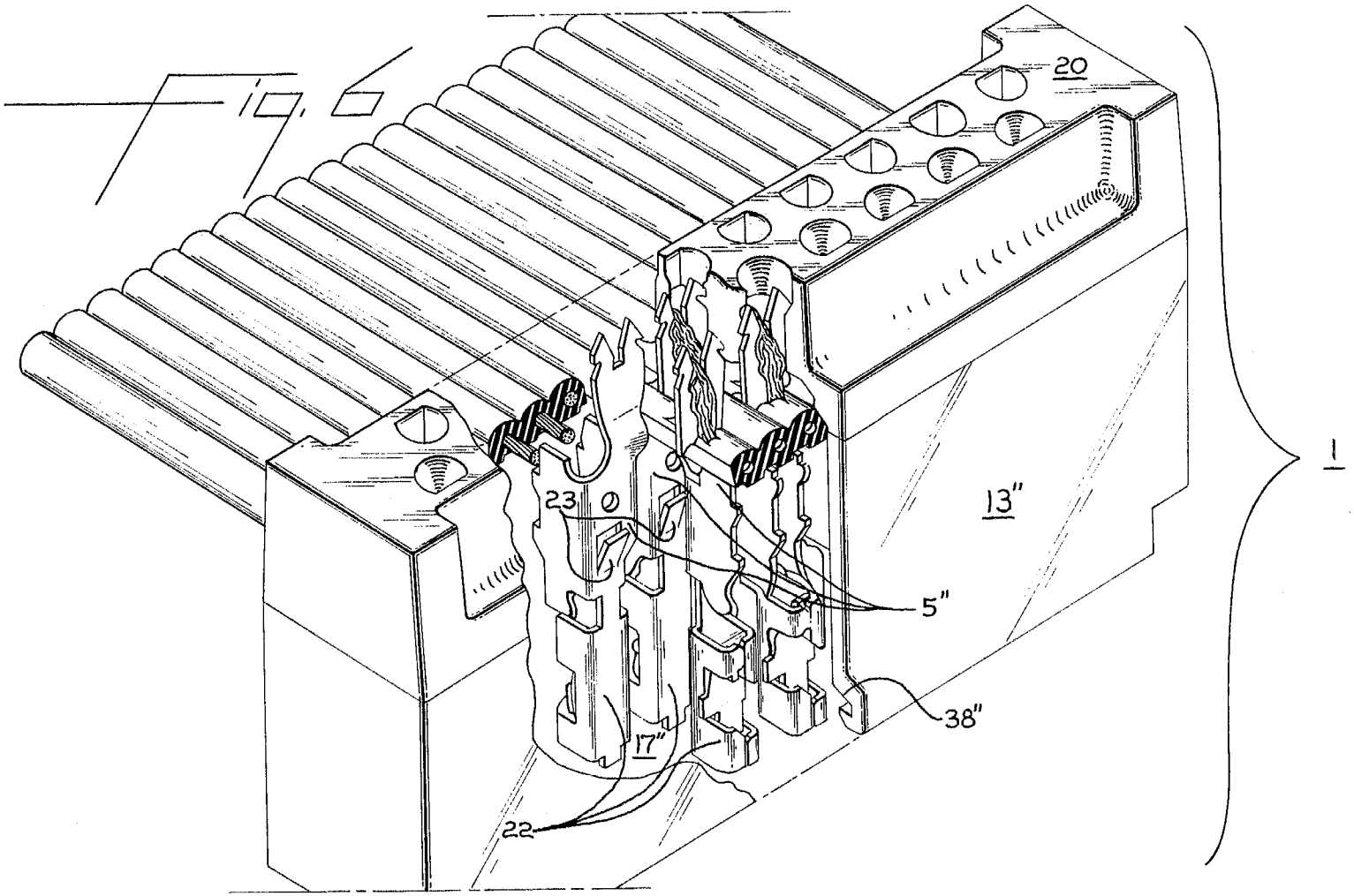
FIGS. 7, 8, 9, 10 and 11 are progressive steps in the making of a connector of this invention.

FIG. 10 illustrates the effect of further relative motion between base tool 24 and insertion tool 25. Tip 10 is shown completely moved into slot 26 and holes 28 and 29 are beginning to accommodate conductor 3. The beginning of the formation of a tight bight over slot 7 is also shown. Insulation 4 is thinned out above the top of the bight and is compressed below it.

FIG. 11, shows the complete formation of a tight bight through slot 7 over element 5' with the the wire exposed through the insulation. Tool 25 is removed at this stage and hence not shown in this figure. When a multistrand conductor is employed, it tends to assume the cross-sectional configuration shown in FIG. 4.

To maintain electrical continuity under extreme service conditions, it is preferred to bond conductors 3 to interconnecting elements 5' in order to avoid or minimize the long range effects of corrosion and vibration. Such bonding can be achieved by a variety of metallurgical bonding techniques.

In order to ensure permanent bonding, it is important that the interconnecting element 5 is positioned in the foundation portion 13 of the dielectric housing so that when the conductor is located at the base of slot 7 it is bent back on itself forming a bight over the base of the tine. A loop is thereby formed and the conductor is exposed, the loop having a height of at least the thickness of the conductor above the top of the insulation. Higher loops are acceptable up to a height limited by the practicable necessity of covering the inserted connector in a dielectric housing cover. Such a position is shown in FIG. 3. The inserted conductor 3 is thereby bent back on itself forming a bight 6 over the base 7 of said tines. The conductor is exposed from its insulation 4 at the apex of the bight 6. This exposed conductor can then be bonded to the tine directly by a laser weld or can be crimped by the tines and then laser welded to form a permanent electrical bond as shown at 50° in FIG. 18.

Figure 12:
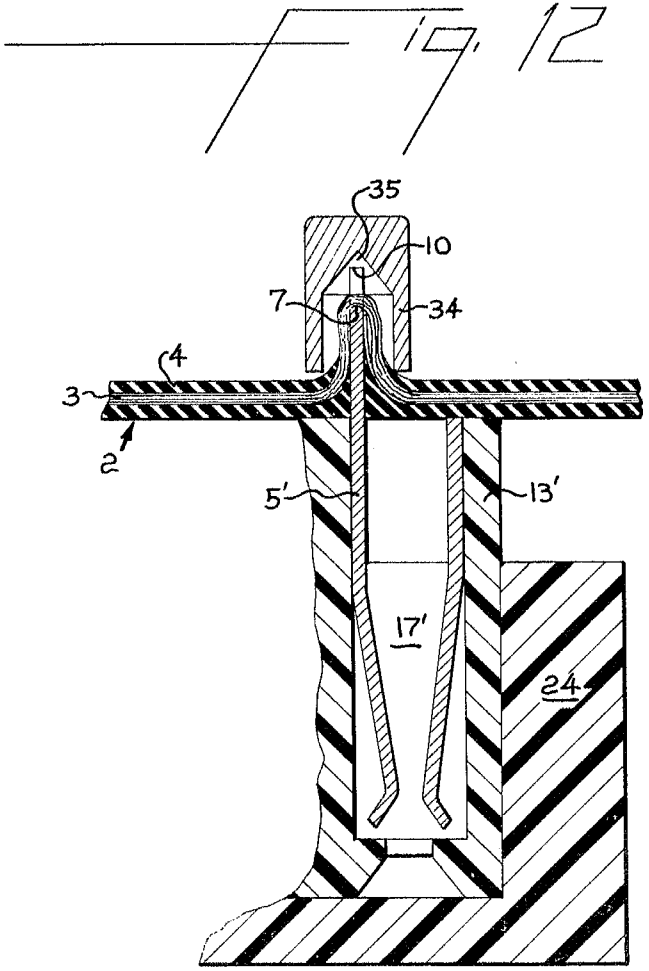
FIG. 12 is a cross-section of a preferred crimping step in the making of a connector of this invention.
Figure 14:
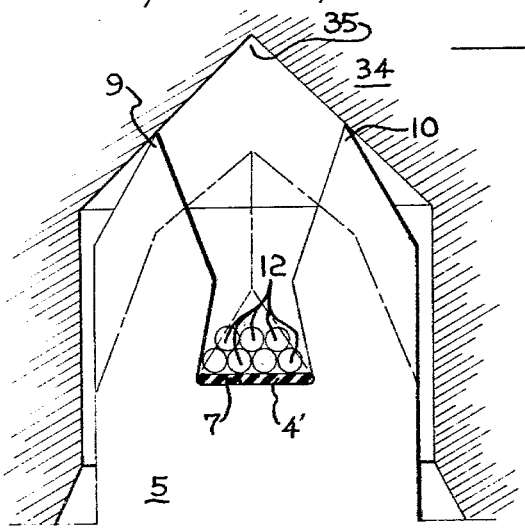
FIG. 14 is a considerably enlarged cross-sectional view of a crimping tool, useful in performing the preferred step of FIG. 12, in association with an interconnecting element.

In FIG. 12, each tight bight formed in conductor 3 over an interconnecting element 5' has been subjected to the action of a crimping tool 34. This crimping tool is illustrated in FIG. 14 and comprises a series of appropriately spaced holes of controlled depth and having a blind conical base 35. The conical base preferably has a 90° angle. The holes are sized as shown in FIG. 14 so that opposing motion between tool 34 and base tool 24 causes the crimping of tips 9 and 10 together as shown by the phantom lines in FIG. 14. Thus, strands 12 are mechanically held in place in slot 7 above insulation portion 4'. The configuration shown by the phantom lines is schematic, in actual practice, the closure between the arrowheads is less uniform.

Metallurgical bonding produces permanent interface between conductors 3 and elements 5 leading to improved electrical continuity in service. Laser welding is the preferred technique utilized in obtaining the electrical connection and wiring device of this invention.

By metallurgical bonding is meant an electrical contact formed between interconnecting element and conductor in such a manner that some metal-metal fusion occurs. Such bonding is brought about by the application of some form of energy at or near the area where a rigid bond is to be formed. Metallurgical bonding techniques include a variety of welding methods such as laser beam welding.

LBW has several advantages over other welding methods, e.g., it does not require electrode contact or flux. LBW has high heat intensity and the beam impacts on a small area; these factors contribute to localized heating and rapid cooling resulting in a small heat-affected zone. The highly collimated monochromatic beam of light generated in a laser is focused on a surface and is partially reflected, and partially absorbed. Optimum welding performance depends on absorptivity, thermal conductivity, density, heat capacity, melting point, and surface condition of the metals to be joined as well as the characteristics of the laser such as power density, wave length and pulse length.

It has been found that a pulsed neodymium laser (using Nd Glass with an output of 10–15 joules) can successfully weld cupro-nickel, gold flashed materials, and phosphor-bronze. All of these materials afford acceptable quality welds, CuNi being the best. For example, welding cupro-nickel to copper, joint resistances of less than 1 milliohm are obtained versus 10–15 milliohms range considered to be the maximum allowable. Also, a direct tension strength of 1.5–4 pounds per termination is achieved.

A technique favored for carrying out laser welding involves positioning the welder so that its beam is within 90° of perpendicular to the long axis of the interconnecting element 5 and is aligned with the center of slot 7 after crimping. Approximately 5 millisecond-pulse length of the laser, delivering 10–15 joules, can accomplish the bonding of an element 5 to the corresponding conductor 3. Such an operation of the laser is said to be operating in the conventional mode. Either or both of tips 9 and 10 of interconnecting elements 5 are partially melted and flow over and between heated strands 12 of conductor 3 forming a metallurgical bond.

Both tinned and untinned wire can be welded to CuNi with a pulsed $CO_2$ laser. Such welds can achieve junction resistances of from 0.05–0.30 milliohm and shear strengths of from 2.7–4.8 pounds to break.

Most preferably, an Nd YAG (yttrium aluminum garnet) pulsed laser is utilized for high speed multiple welds. The most preferred laser weld is accomplished by contouring the laser beam and aiming it so that a significant portion of the energy falls upon the conductor. This appears to preheat the conductor so that good fusion is obtained. The major portion of the beam is directed on the tines 9 and 10. They are melted and the melt contacts the exposed conductor and fuses to it. The laser is employed using a circular beam shape with an overall diameter of 0.090 to 0.100 inch and a concentric high energy core ranging between 0.055 and 0.075 inch in diameter. The core is centered on a point on the tines above conductor strands 12 approximately 0.020 to 0.025 inch and in line with slot 7 placing the strands on the edge of the beam core or within it. This configuration provides good welds without destruction of the conductor using a Nd YAG laser operated in a pulsed mode with pulse energy levels of 10–15 joules.

Other beam shapes besides circular are known and adaptable to the welding process such as rectangular, square, figure "8," or modifications thereof such as concentric rings. Each may apply in particular instances. Similarly known are the means to vary the beam dimensions. These include beam divergence, power and especially optics.

FIG. 18 shows a dielectric housing foundation 13 containing interconnective elements 5 passing in front of a laser beam after the pierced flat cable 2 has been bent over and the conductor 3 exposed in the bight 6 at the base of the tines. The conductor is shown with the tines squeezed shown before the laser beam hits the tines and the bight 6 causing a metallurgical bond 50 to form. This bond makes the connection permanent.

After the bonding is completed, cap 20 is installed and sealed to foundation 13. It is preferred to position cap 20 in a fixture under an ultrasonic horn so that elements 5 are aligned to enter holes 21 in cap 20 in interference fit for permanent attachment. Cap 20 can also be ultrasonically bonded to foundation 13 thereby yielding a connector assembly as shown in FIGS. 1, 5 or 6.

We claim:

1. In an electrical connection having at least one interconnective element with a pair of tines defining a slot terminating in a base for receiving an electrical conductor, said interconnective element being positioned within a channel in a dielectric housing, the improvement wherein the conductor is bent back on itself forming a bight over the base of said tines such that a loop is formed, said loop being at least one conductor thickness high, said conductor being exposed from its insulation at the apex of said bight and being permanently bonded at said apex to the tines.

2. The electrical connection of claim 1 wherein said conductor is permanently bonded to the tines by a laser weld.

3. The electrical connection of claim 1 wherein the tines are squeezed to the conductor and the conductor is permanently bonded to the tines by a laser weld.

4. An electrical connection according to claim 1 wherein said interconnective element has said pair of tines at a first end and another electrical contact at a second end.

5. An interconnective element in a dielectric housing according to claim 4 wherein the second end of the element is a dual beam female contact.

6. An interconnective element in a dielectric housing according to claim 4 wherein the second end of the element is a single beam female contact.

7. An interconnective element in a dielectric housing according to claim 4 wherein the second end of the element is a dual-metal receptacle.

8. An interconnective element in a dielectric housing according to claim 4 wherein the second end of the element is an edgecard receptacle.

9. An interconnective element in a dielectric housing according to claim 4 wherein the second end of the element is a male pin.

10. An electrical connector comprising:

insulated flat cable with a plurality of parallel electrical conductors encased in a uniform tight-fitting insulation:

at least one connector assembly in electrical attachment to the cable, the assembly including insulating foundation and cover attached to each other and interconnecting elements mounted in said foundation in line array, there being at least one interconnecting element for at least one conductor in each assembly;

the interconnecting elements disposed in at least one plane normal to the flat cable;

each interconnecting element having first and second ends, the first end formed as insulation-piercing tines defining a slot and a base at the bottom of the slot and the second end formed as an electrical terminal for plug-in service; and the insulation-piercing tines cutting through the insulation of the cable so that a conductor is formed into a bight over the base of said tines such that a loop is formed, said conductor being exposed outside its insulation and in electrical contact with said first end; and the conductor being permanently bonded to said first end.

11. The connector according to claim 10 wherein said interconnecting element and said conductor are bonded by means of a laser weld.

12. The connector according to claim 10 wherein said interconnecting element and said conductor are bonded by means of a crimp and a laser weld.

13. The connector of claim 10 wherein said interconnecting elements are mounted in said foundation in at least two staggered parallel rows.

14. The connector of claim 10 wherein said cover has a pointed edge in contact transverse and normal to the insulation of the flat cable providing strain relief.

15. The connector according to claim 11 wherein the laser weld is achieved with a Nd YAG laser.

16. A method of terminating with connectors an insulated flat cable having a plurality of parallel electrical conductors encased in a unitary tight-fitting insulation comprising the sequential steps of:

simultaneously penetrating the cable with plurality of insulation-piercing interconnecting elements disposed normal with respect to the cable, each element having a slot therein which has a base, there being at least one interconnecting element for at least one conductor in each connector;

simultaneously bottoming conductors in the slots of said elements;

displacing the cable relative to the interconnecting elements whereby limited lengths of each of the bottomed conductors are displaced in a loop from the plane of the cable and outside the insulation;

forming the displaced conductors around the interconnecting elements into tight bights each having standing parts in close proximity to opposite sides of the interconnecting elements with the apices of the bights formed over the bases of the slots;

permanently bonding the conductor to the interconnecting element; and covering the interconnecting elements with a dielectric housing whereby an insulated connector suitable for plug-in service is formed.

17. The method of claim 16 wherein said bonding step is carried out by metallurgical bonding after a mechanical squeezing step.

18. The method of claim 17 wherein said metallurgical bonding is laser welding, wherein the welder is positioned such that the laser beam is within 90° of perpendicular to the long axis of the interconnecting elements.

* * * * *